US009526945B1

(12) United States Patent
Edmondson

(10) Patent No.: US 9,526,945 B1
(45) Date of Patent: Dec. 27, 2016

(54) RANGE-OF-MOTION EXERCISE DEVICE AND METHOD FOR EXERCISING TO PROMOTE INCREASED RANGE OF MOTION

(71) Applicant: Michael Edmondson, Granite Falls, NC (US)

(72) Inventor: Michael Edmondson, Granite Falls, NC (US)

( * ) Notice: Subject to any disclaimer, the term of this patent is extended or adjusted under 35 U.S.C. 154(b) by 75 days.

(21) Appl. No.: 14/208,048

(22) Filed: Mar. 13, 2014

Related U.S. Application Data

(60) Provisional application No. 61/792,042, filed on Mar. 15, 2013.

(51) Int. Cl.
*A63B 23/04* (2006.01)

(52) U.S. Cl.
CPC ..... *A63B 23/0494* (2013.01)

(58) Field of Classification Search
CPC ..... A61H 1/0259; A61H 1/024; A61H 2201/1642; A61H 2205/102; A61H 2205/106; A61H 2205/12; A63B 21/00178; A63B 23/03508; A63B 23/0417; A63B 23/0494
See application file for complete search history.

(56) References Cited

U.S. PATENT DOCUMENTS 1,240,809 A 9/1917 Baldwin
2,058,563 A 12/1934 Campbell
2,845,063 A 7/1958 Allen
4,229,001 A 10/1980 Roman
4,323,060 A 4/1982 Pecheux
4,463,947 A 8/1984 Kloenne
4,492,222 A 1/1985 Hajianpour
4,509,509 A 4/1985 Bouvet et al.
4,558,692 A 12/1985 Greiner
4,603,687 A 8/1986 Greenwood
4,621,620 A 11/1986 Anderson
4,665,899 A 5/1987 Farris et al.
4,844,454 A 7/1989 Rogers
5,273,520 A 12/1993 Rebmann
5,277,680 A 1/1994 Johnston
5,324,245 A 6/1994 Fontana et al.
5,405,306 A 4/1995 Goldsmith et al.
5,728,034 A * 3/1998 Lamothe ..... A63B 22/0076 482/131
6,110,083 A 8/2000 Riser
(Continued)

*Primary Examiner* — Loan H Thanh
*Assistant Examiner* — Rae Fischer
(74) *Attorney, Agent, or Firm* — Schwartz Law Firm, P.C.

(57) ABSTRACT

A knee range-of-motion exercise device includes a rail assembly, foot sled, and single continuous stretch-control rope. The rail assembly has opposing first and second ends, and at least one longitudinal rail extending between the ends. The foot sled is carried on the longitudinal rail, and is adapted for longitudinal sliding movement between the first and second ends of the rail assembly. The stretch-control rope has a first free end attached to the foot sled, a second free end attached to the first end of the rail assembly, a first looped end passed around a first pass-around rope guide fixed to the second end of the rail assembly, a second looped end passed around a second pass-around rope guide fixed to the foot sled, and a third looped end extending freely outwardly from the first end of the rail assembly for access by a user.

17 Claims, 7 Drawing Sheets

(56) References Cited

U.S. PATENT DOCUMENTS

| | | | | |
|---|---|---|---|---|
| 6,962,570 | B2 * | 11/2005 | Callanan et al. | A61H 1/024 482/95 |
| 2003/0171196 | A1 | 9/2003 | Cunningham | |
| 2006/0065055 | A1 * | 3/2006 | Barshinger et al. | B61K 9/10 73/609 |
| 2007/0149368 | A1 * | 6/2007 | Koch | A61H 1/024 482/131 |
| 2011/0208098 | A1 | 8/2011 | Zaborowski | |
| 2012/0232438 | A1 | 9/2012 | Cataldi et al. | |

* cited by examiner

RANGE-OF-MOTION EXERCISE DEVICE AND METHOD FOR EXERCISING TO PROMOTE INCREASED RANGE OF MOTION

TECHNICAL FIELD AND BACKGROUND OF THE INVENTION

This invention relates broadly and generally to a range-of-motion (ROM) exercise device and method. "Range of motion" is a term used to describe a degree of movement available at each joint. Every joint in the body has a "normal" range of motion. Joints maintain their normal range of motion by being moved. ROM exercises are done to keep the body flexible, especially if there is a medical problem or condition that restricts proper exercise. Active range of motion exercises are done by the patient himself, while passive range of motion done for the patient by a therapist.

SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a knee range-of-motion exercise device. The exercise device comprises a rail assembly having opposing first and second ends, and at least one longitudinal rail extending between the ends. A mobile foot sled is carried on the longitudinal rail, and is adapted for longitudinal sliding movement between the first and second ends of the rail assembly. A single continuous stretch-control rope has a first free end attached to the foot sled, a second free end attached to the first end of the rail assembly, a first looped end passed around a first pass-around rope guide fixed to the second end of the rail assembly, a second looped end passed around a second pass-around rope guide fixed to the foot sled, and a third looped end extending freely outwardly from the first end of the rail assembly for access by a user.

The term "rope" is broadly defined herein to mean single or multi-filament, twisted or untwisted, flexible cord-like structure made of hemp, nylon, or other natural or synthetic fibers, metal wire, polymer, or other materials.

The user of the exercise device places a foot on the foot sled, and by selectively pulling the third looped end of the stretch-control rope in opposite directions, actively controls sliding bidirectional movement of the foot sled between the first and second ends of the rail assembly, thereby urging a knee of the user into flexion and extension at respective points of resistance.

According to another exemplary embodiment, the rail assembly comprises first and second laterally spaced, parallel, longitudinal (e.g., metal) rails.

According to another exemplary embodiment, the first and second ends of the rail assembly comprise respective first and second lateral crossbars interconnecting the longitudinal rails.

According to another exemplary embodiment, the first crossbar defines spaced apart pass-through guide holes for receiving and guiding the stretch-control rope through the crossbar.

According to another exemplary embodiment, spaced apart pass-through rail guides are attached to an underside of the foot sled, and are adapted for slidably receiving the first and second longitudinal rails.

According to another exemplary embodiment, the first and second rope guides comprise respective rotatable pulleys.

According to another exemplary embodiment, at least one pass-through rope guide is attached to an underside of the foot sled.

According to another exemplary embodiment, an ankle cuff (or strap) is attached to the foot sled, and is adapted for releasably securing the foot of the user to the exercise device.

According to another exemplary embodiment, a plurality of surface spacers are located at the ends of the rail assembly for spacing the foot sled from an adjacent supporting surface.

According to another exemplary embodiment, the foot sled has a padded top surface.

In another exemplary embodiment, the present disclosure comprises a knee range-of-motion exercise device incorporating a rail assembly, a mobile low-profile foot sled, and a single continuous stretch-control rope. The rail assembly has opposing first and second ends, and at least one longitudinal rail extending between the ends. The low-profile foot sled is carried on the longitudinal rail, and is adapted for longitudinal sliding movement between the first and second ends of the rail assembly. The foot sled has a substantially uniform height dimension of less than 3 inches. The stretch-control rope has a first free end attached to the foot sled, a second free end attached to the first end of the rail assembly, a first looped end passed around a first pass-around rope guide fixed to the second end of the rail assembly, a second looped end passed around a second pass-around rope guide fixed to the foot sled, and a third looped end extending freely outwardly from the first end of the rail assembly for access by a user.

The user of the exercise device places a foot on the foot sled, and by selectively pulling the third looped end of the stretch-control rope in opposite directions, actively controls sliding bidirectional movement of the foot sled between the first and second ends of the rail assembly, thereby urging a knee of the user into flexion and extension at respective points of resistance.

In yet another exemplary embodiment, the present disclosure comprises a method for exercising a knee of a user to promote an increased range of motion. The method includes securing a foot of the user to a mobile foot sled carried on a longitudinal rail assembly. The foot sled is adapted for longitudinal sliding movement between first and second ends of the rail assembly. Using a single continuous stretch-control rope attached at a first end to the rail assembly and at a second end to the foot sled, the user actively controls sliding bidirectional movement of the foot sled between the first and second ends of the rail assembly by selectively pulling an intermediate looped end of the rope in opposite directions, thereby urging the knee into flexion and extension at respective points of resistance.

BRIEF DESCRIPTION OF THE DRAWINGS

Exemplary embodiments of the present invention will hereinafter be described in conjunction with the following drawing figures, wherein like numerals denote like elements, and wherein.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
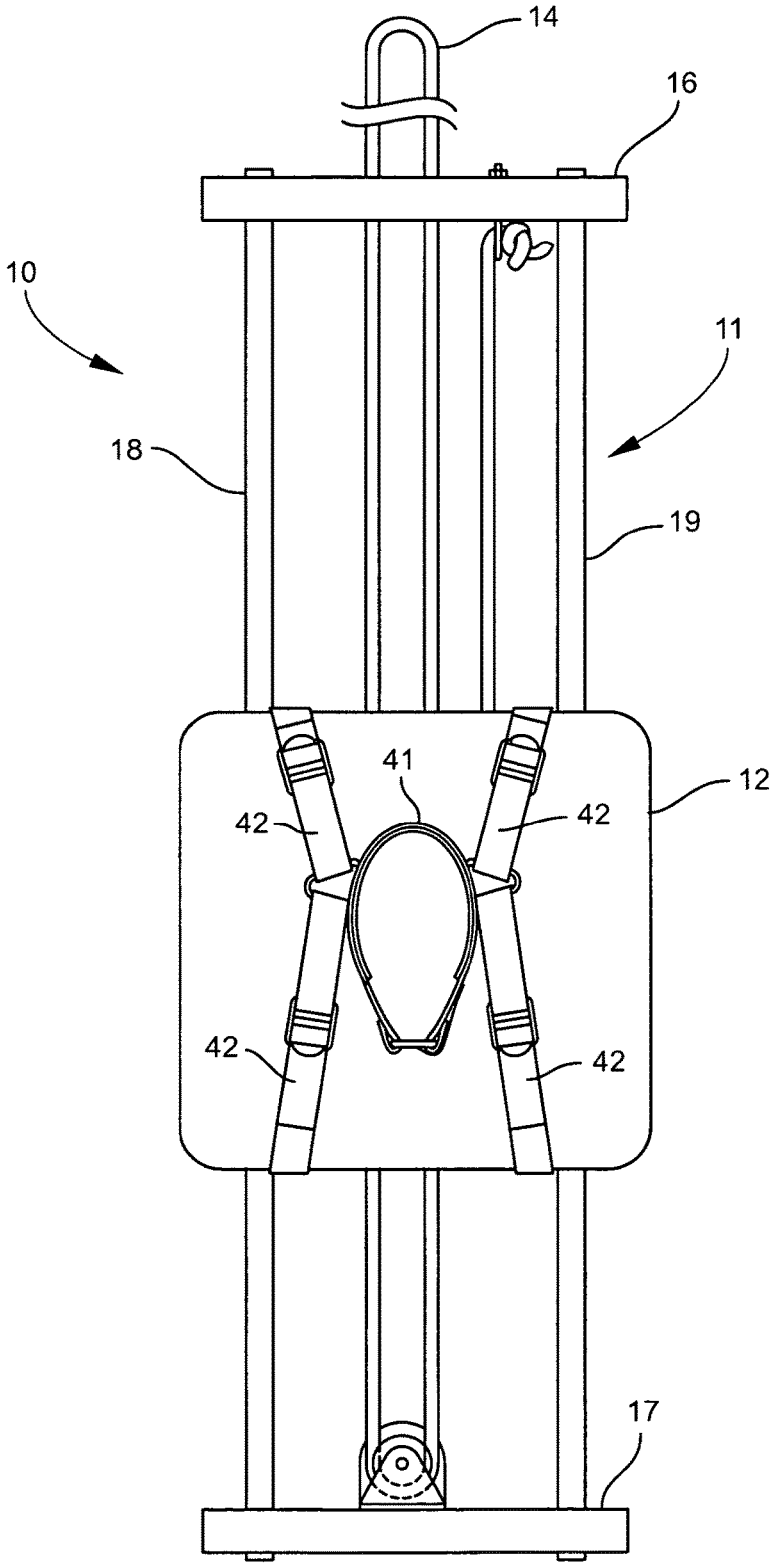
FIG. 1 is a top view of a knee ROM exercise device according to one exemplary embodiment of the present disclosure.

Referring now specifically to the drawings, a range-of-motion (ROM) exercise device according to one exemplary embodiment of the present disclosure is illustrated in FIG. 1, and shown generally at broad reference numeral 10. The ROM exercise device 10 is designed to mimic hands-on therapeutic techniques applying active assisted and passive range of motion anatomical flexion and extension of the knee, stretching, and joint distraction/long axis traction force. Exemplary applications of the present device 10 include rehabilitation following knee injury and surgical procedures, such as knee replacement and arthroscopic debridement, and physical therapy for patients with joint pain, arthritis, and other knee pathologies. In other applications, the exemplary ROM exercise device 10 may be used for active assisted and passive range of motion flexion and extension in other body joints.

Figure 2:
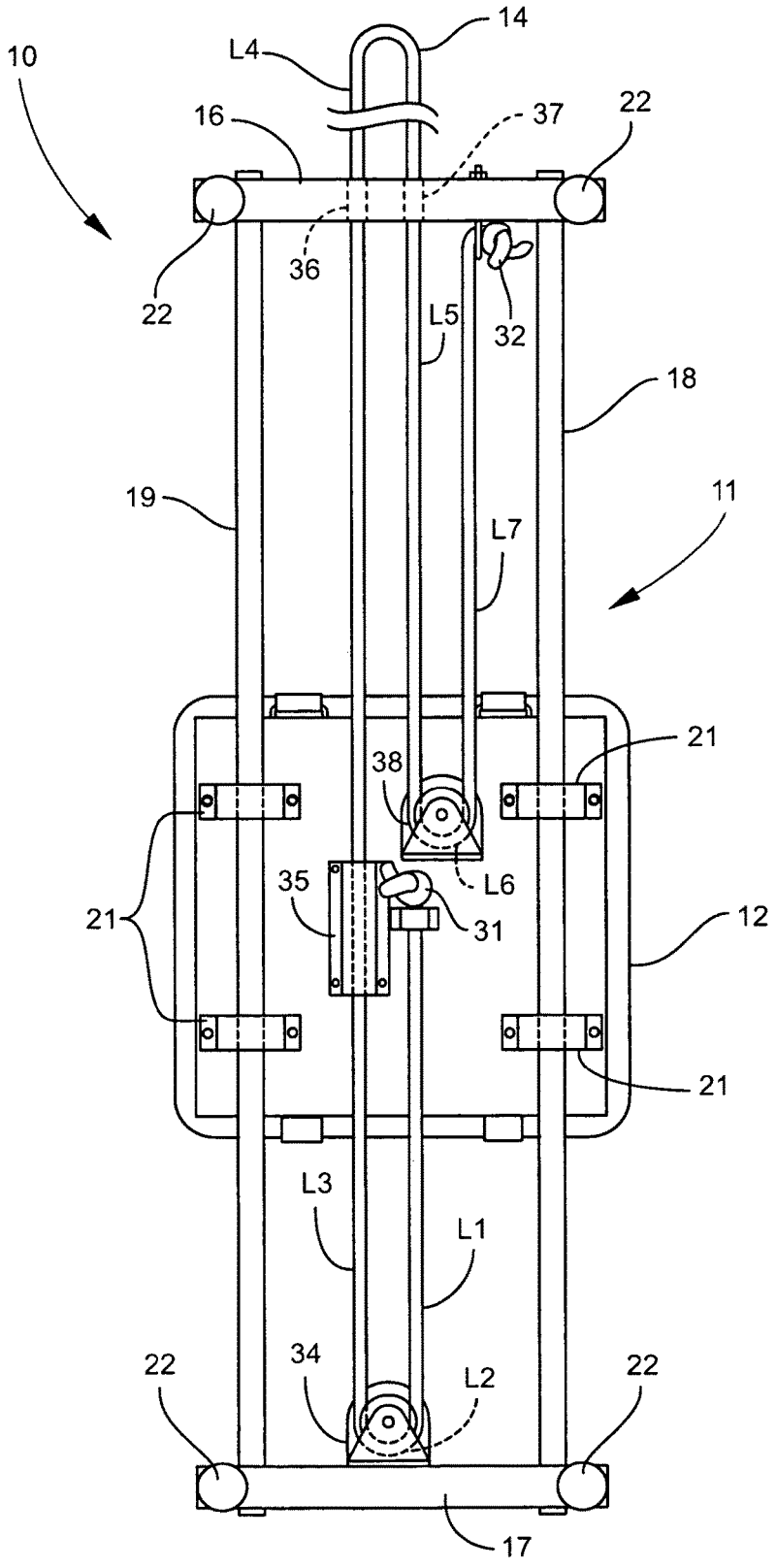
FIG. 2 is a bottom view of the exemplary knee ROM exercise device.
Figure 3:
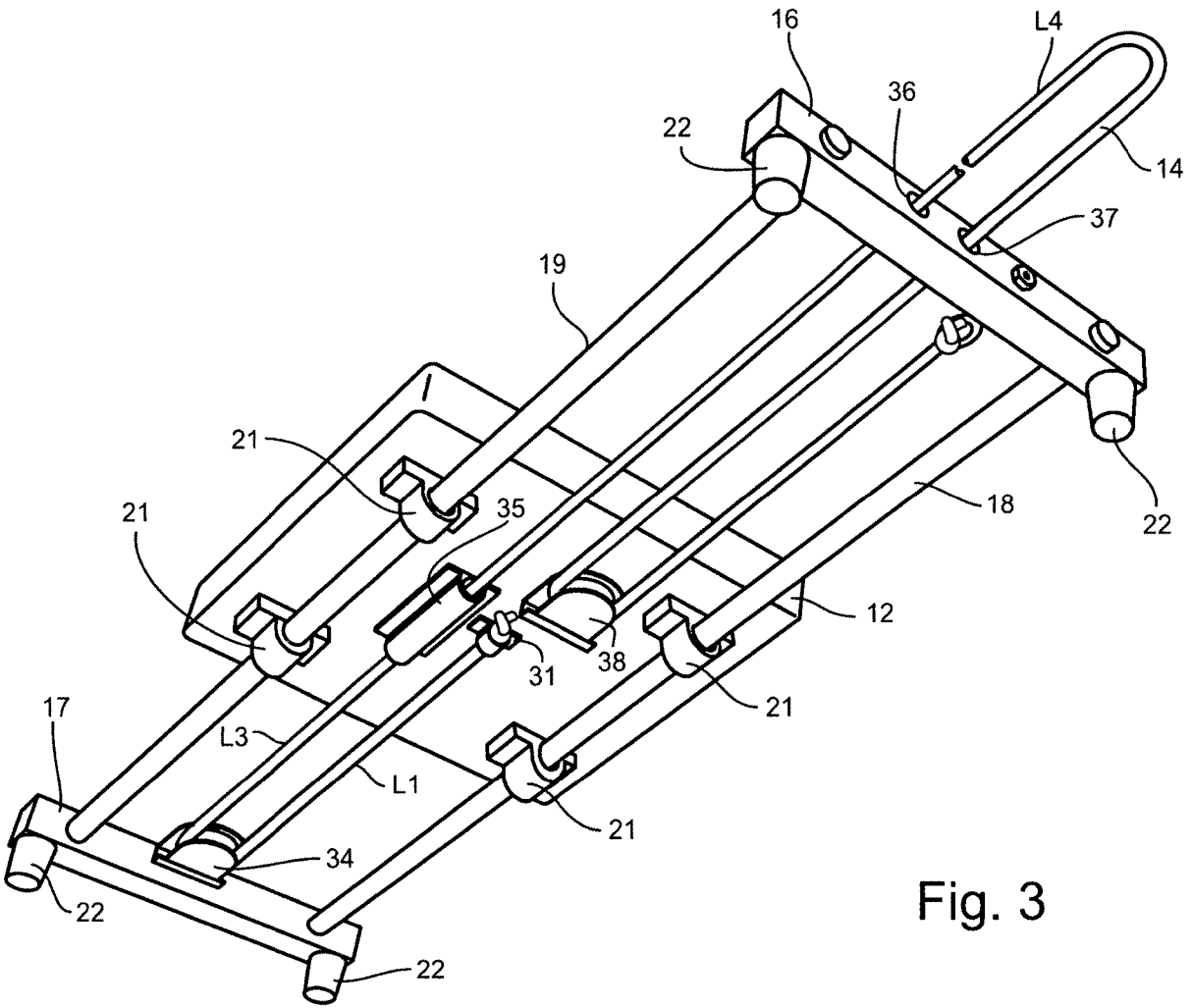
FIG. 3 is a bottom perspective view of the exemplary knee ROM exercise device.
Figure 4:
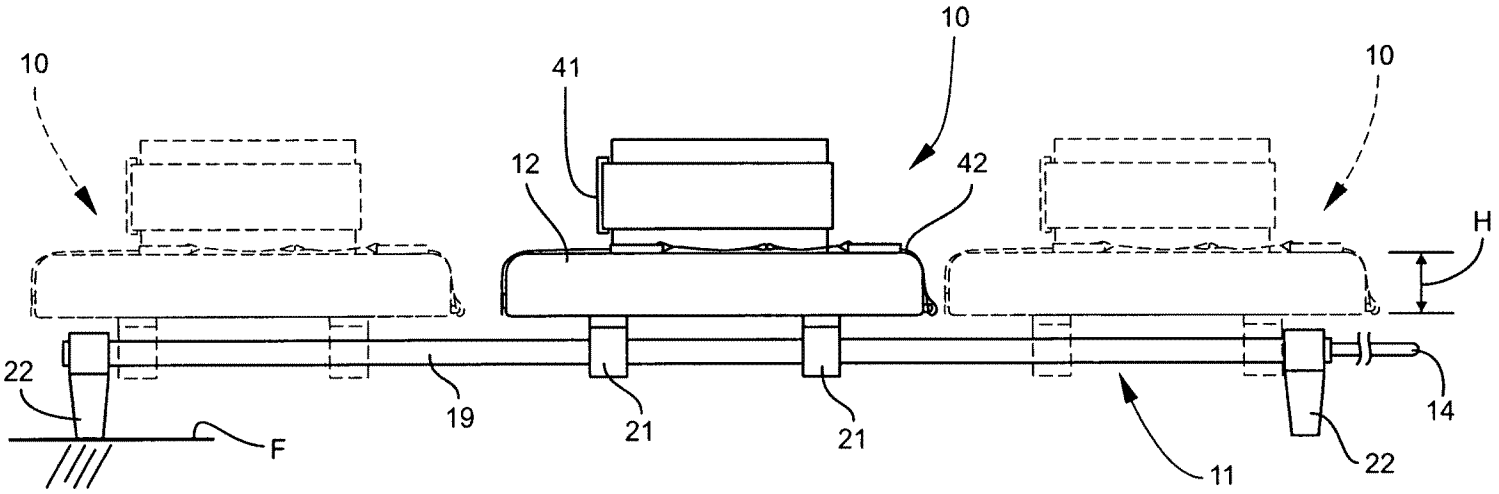
FIG. 4 is a side view of the exemplary knee ROM exercise device showing the mobile foot sled at various locations along a length of the rail assembly.

As best shown in FIGS. 1-3, the present ROM exercise device 10 incorporates a longitudinal lightweight rail assembly 11, a low-profile mobile foot sled 12, and a single continuous stretch-control rope 14. The exemplary rail assembly 11 has lateral metal crossbars 16, 17 at respective opposite ends, and parallel cylindrical metal rails 18, 19 extending between and affixed to the crossbars 16, 17. The mobile foot sled 12 is slidably carried on the longitudinal rails 18, 19 of the rail assembly 11, and is secured to the ROM exercise device 10 by pass-through low friction rail guides 21 fastened to an underside of the sled 12. The rail guides 21 function to guide and stabilize sliding movement of the mobile foot sled 12 along an entire length of the rail assembly 11 from one crossbar to the other. The exemplary rail guides 21 are set back from respective lateral edges of the foot sled 12, as best illustrated in FIG. 4, such that at opposite extreme locations on the rail assembly 11, the foot sled 12 extends slightly beyond the crossbars 16, 17. The mobile foot sled 12 may be spaced apart above a supporting surface (e.g., floor "F") by non-slip rubber feet 22 attached to the crossbars 16, 17.

The exemplary stretch-control rope 14 of the ROM exercise device 10 has a first free end 31 attached to an underside of the mobile foot sled 12, as shown in FIGS. 2 and 3, and a second free end 32 attached to the crossbar 16 of rail assembly 11. The rope ends 31, 32 may be knotted and attached to the ROM exercise device 10 by any suitable means, such as eyebolts, U-bolts, clamps, staples, or other hardware. The remainder of the stretch-control rope 14 is looped at various points between its first and second ends 31, 32. From its first attached end 31, the stretch-control rope 14 has a variable length portion "L1" extending longitudinally to an intermediate looped end "L2" at a first pass-around rope guide 34. The rope guide 34 is fixed to the crossbar 17 of rail assembly 11, and may comprise a rotatable pulley or any low-friction arcuate stationary form or structure. From rope guide 34, the stretch-control rope 14 has a continuous length portion "L3" extending longitudinally through a tubular pass-through rope guide 35 attached to the underside of foot sled 12, and outwardly through a rope hole 36 formed with the opposite crossbar 16 of rail assembly 11 to a distal looped end "L4". The distal looped end "L4" extends outwardly from the rail assembly 11, and is intended for ready access by a user during ROM exercises, as discuss further below. From distal looped end "L4", the stretch-control rope 14 passes back through a second rope hole 37 formed with the crossbar 16. A variable length portion "L5" extends longitudinally from the crossbar 16 to a second pass-around rope guide 38 attached to the underside of foot sled 12. Like the first guide 34, the pass-around rope guide 38 may comprise a rotatable pulley or any low-friction arcuate stationary form or structure. From the looped portion "L6" at rope guide 38, the stretch-control rope 14 extends along a variable length portion "L7" to its second free end 32 attached to the crossbar 16 of rail assembly 11. In the exemplary embodiment, rope portions "L1", "L3", "L5" and "L7" extend (in tension) substantially parallel to rails 18, 19, and rope portions "L1" and "L5" are in substantial linear alignment. The exemplary stretch-control rope 14 may be fabricate of any suitable flexible and substantially nonstretch material including twisted nylon, hemp, or other yarns, cable wire, or the like.

As best shown in FIGS. 1 and 4, in one exemplary embodiment, the mobile foot sled 12 comprises a flat wood or polymer base and a padded top which together have a height dimension "H" of less than about 3 inches. A multi-point ankle cuff 41 is attached by straps 42 to the top of the foot sled 12, and is adapted to wrap around and releasably secure the foot of the user (e.g., using hook and loop fasteners or the like) to the ROM exercised device 10.

Figure 5:
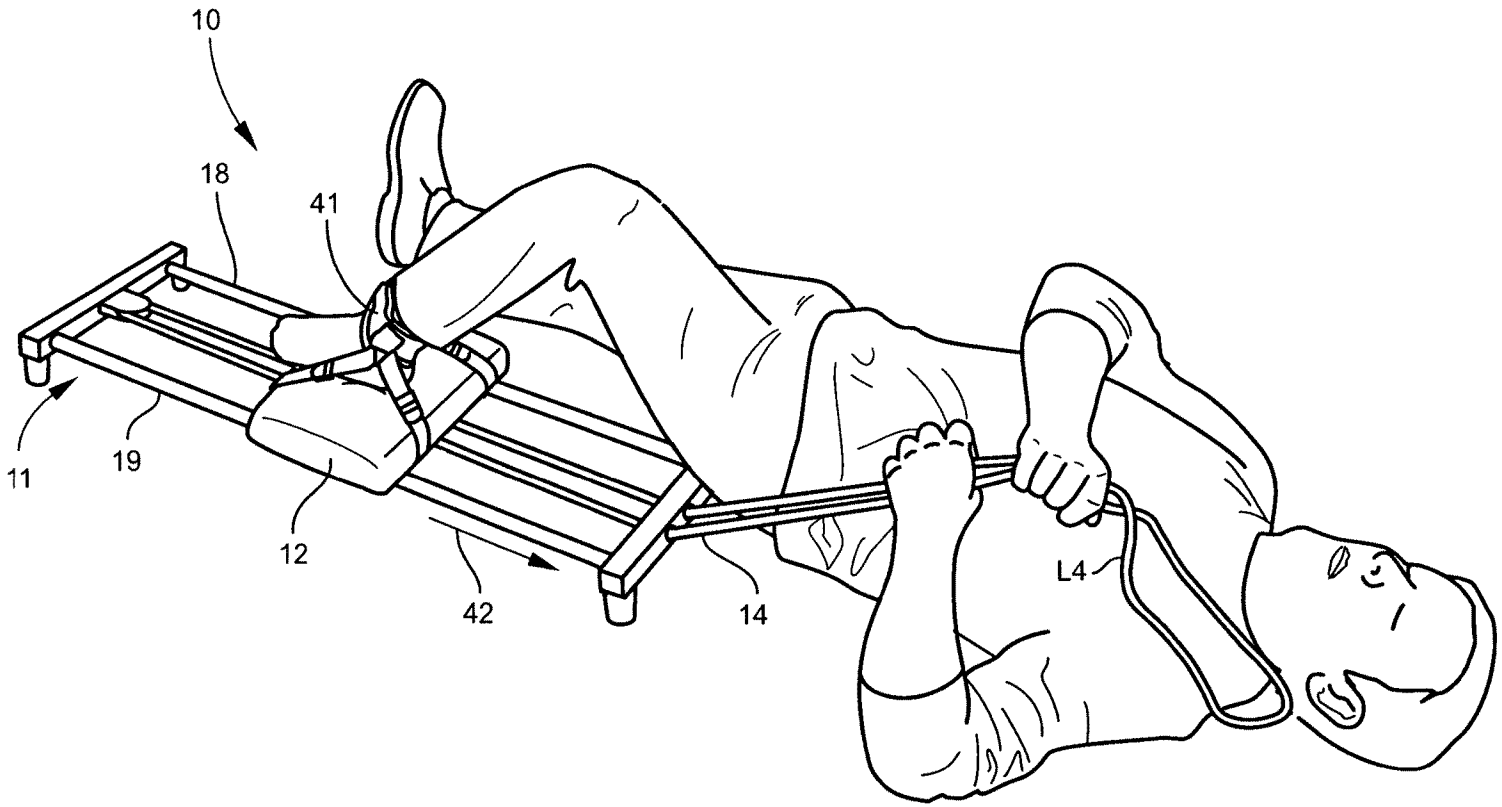
FIGS. 5, 6, and 7 are views demonstrating an exemplary implementation of the present ROM exercise device.
Figure 6:
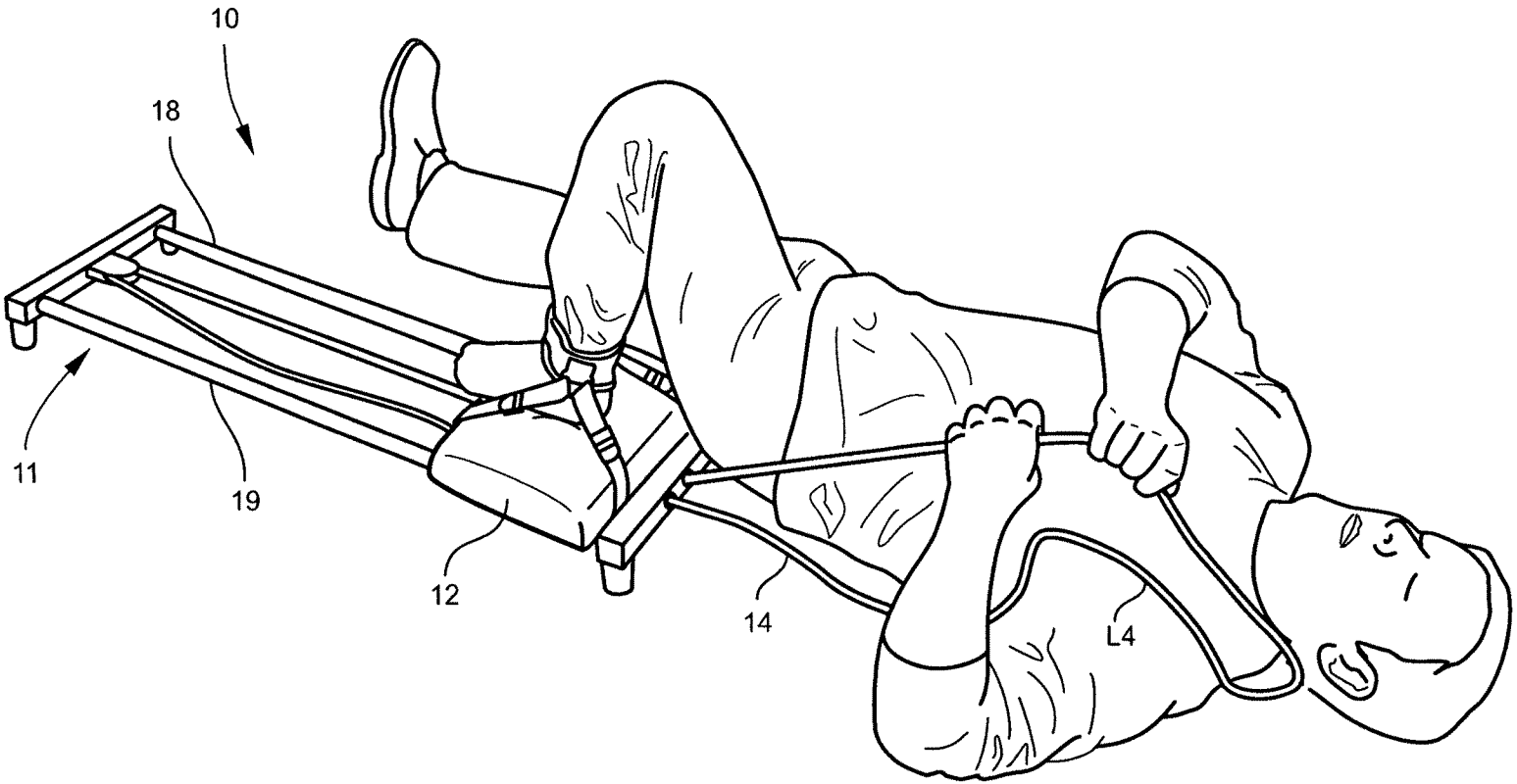
Figure 7:
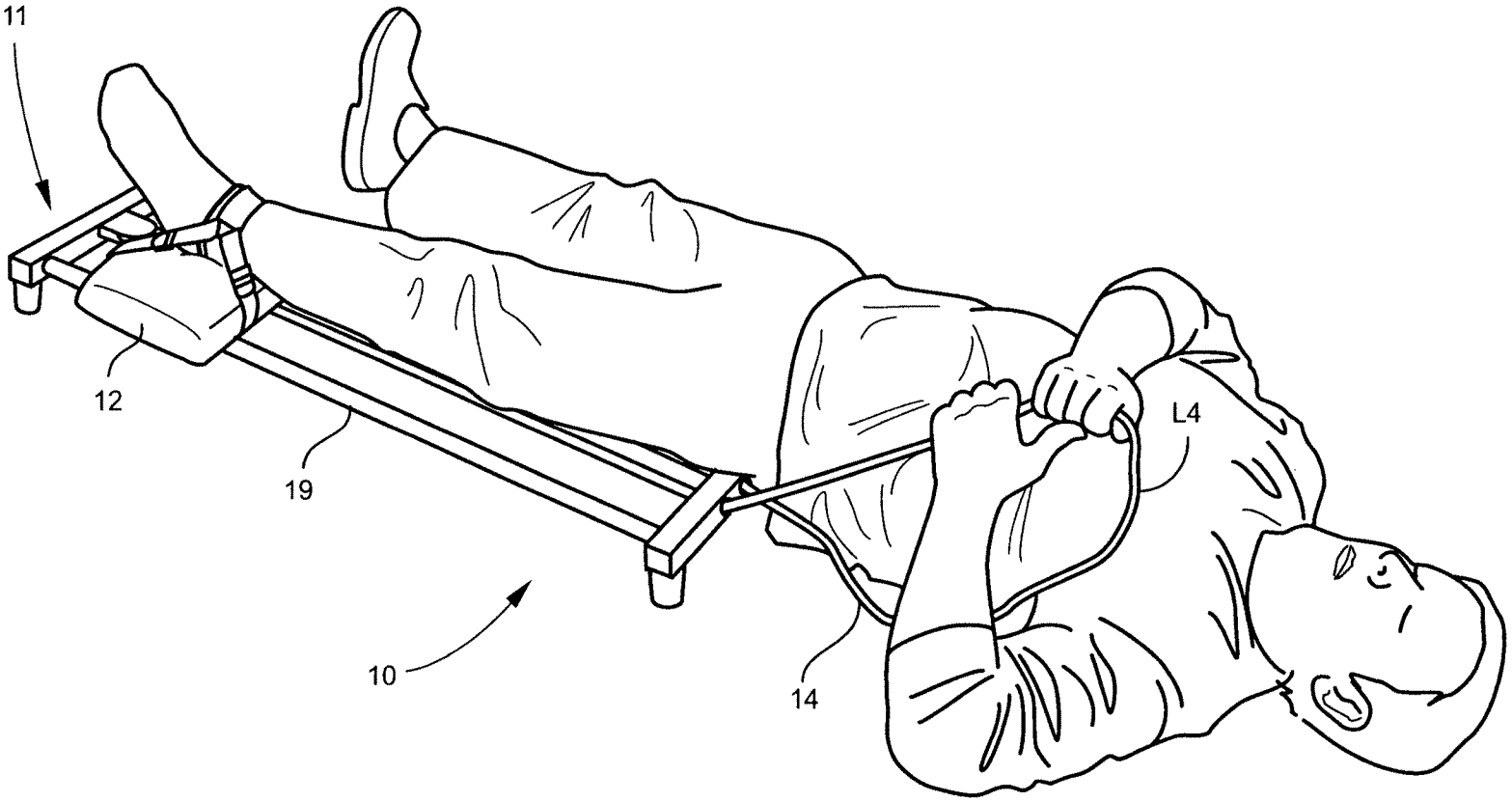

FIGS. 5, 6, and 7 demonstrate an exemplary implementation of the present ROM exercise device 10 for active assisted flexion and extension of the knee. After attaching the ankle cuff 41 and securing the foot to the mobile foot sled 12, the user lies in supine on the floor (or reclined) with the crossbar 16 of rail assembly 11 located under the posterior thigh proximate the horizontal gluteal crease, and the longitudinal rails 18, 19 extending distally in line with the leg to be exercised. While positioned as shown in FIG. 5, the user gently pulls the distal looped end "L4" of stretch-control rope 14 thereby sliding the mobile foot sled 12 towards the gluteal muscles in a linear direction indicated at arrow 42. This movement allows the knee to find and bend about its own axis of rotation. The user can then slowly urge the knee into flexion by grasping and pulling one length of the looped end "L4" (in a first direction). The knee is held at its maximum ROM flexion point for approximately 5 seconds, and is then relaxed and slowly straightened. When relaxed and straightened, the user can further stretch the leg and urge the knee into extension by grasping and gently pulling the second rope length of looped end "L4" (in a second direction opposite the first). This movement extends the knee in the direction indicated at arrow 44. The knee is held in maximum ROM extension for about 5 seconds, and then relaxed. A knee joint distraction mobilization force, such as that created by the ROM exercise device 10, has been clinically shown to benefit range of motion and to reduce pain. In a single therapy session, this process of alternating maximum ROM flexion and extension may be repeated 10 or more times.

In alternative embodiments of the present disclosure, the ROM exercise device may incorporate 4, 6, or more arcuate rope guides (or pulleys). The rail assembly and mobile foot sled may be constructed of any suitable material. Additionally, the foot sled may have a back cover to hide and protect its underside components. Although the exemplary ROM exercise device is shown in-use on a flat horizontal floor, alternative implementations may locate the device on an incline or against a flat vertical wall.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

What is claimed:

1. A knee range-of-motion exercise device, comprising:

a rail assembly comprising opposing first and second ends, and first and second laterally spaced, parallel, longitudinal rails;

a mobile foot sled carried on the longitudinal rails, wherein the mobile foot sled is adapted for longitudinal sliding movement between the first and second ends of the rail assembly, wherein the mobile foot sled is adapted for releasably securing a foot of the user to the exercise device, and wherein a top surface of the mobile foot sled spans the first and second longitudinal rails and is configured for resting a user's foot directly thereon; and a single continuous stretch-control rope comprising a first free end directly fixed to the foot sled, a second free end directly fixed to the first end of the rail assembly, a first looped end passed around a first rotatable pulley fixed to the second end of the rail assembly, a second looped end passed around a second rotatable pulley fixed to the foot sled, and a third looped end extending freely outwardly from the first end of the rail assembly for access by a user, the third looped end comprising first and second integrally joined rope lengths;

wherein the knee range-of-motion exercise device is configured such that a user of the exercise device places a foot on the foot sled, and by pulling the first rope length of the third looped end of the stretch-control rope, the user actively controls sliding movement of the foot sled in a first linear direction along the longitudinal rails, and by pulling the second rope length of the third looped end of the stretch-control rope, the user actively controls sliding movement of the foot sled in an opposite second linear direction along the longitudinal rails, thereby urging a knee of the user into flexion and extension at respective points of resistance.

2. A knee range-of-motion exercise device according to claim 1, wherein each of the first and second ends comprises a lateral crossbar interconnecting the longitudinal rails.

3. A knee range-of-motion exercise device according to claim 2, wherein the first crossbar comprises spaced apart guide holes for receiving and guiding the rope through the crossbar.

4. A knee range-of-motion exercise device according to claim 3, further comprising spaced apart rail guides attached to an underside of the foot sled, and adapted for slidably receiving the first and second longitudinal rails.

5. A knee range-of-motion exercise device according to claim 1, further comprising a pass-through rope guide attached to an underside of the foot sled.

6. A knee range-of-motion exercise device according to claim 1, further comprising an ankle cuff attached to the foot sled adapted for releasably securing the foot of the user to the exercise device.

7. A knee range-of-motion exercise device according to claim 1, further comprising a plurality of surface spacers attached at the ends of the rail assembly for spacing the foot sled from an adjacent supporting surface.

8. A knee range-of-motion exercise device according to claim 1, wherein the top surface of the mobile foot sled is padded.

9. A knee range-of-motion exercise device, comprising:

a rail assembly comprising opposing first and second ends, and first and second laterally spaced, parallel, longitudinal rails;

a mobile foot sled carried on the longitudinal rails, wherein the mobile foot sled is adapted for longitudinal sliding movement between the first and second ends of the rail assembly, wherein the mobile foot sled is adapted for releasably securing a foot of the user to the exercise device, wherein a top surface of the mobile foot sled spans the first and second longitudinal rails and is configured for resting a user's foot directly thereon, and wherein the foot sled has a substantially uniform height dimension of less than 3 inches; and a single continuous stretch-control rope comprising a first free end directly fixed to the foot sled, a second free end directly fixed to the first end of the rail assembly, a first looped end passed around a first rotatable pulley fixed to the second end of the rail assembly, a second looped end passed around a second rotatable pulley fixed to the foot sled, and a third looped end extending freely outwardly from the first end of the rail assembly for access by a user, the third looped end comprising first and second integrally joined rope lengths;

wherein the knee range-of-motion exercise device is configured such that a user of the exercise device places a foot on the foot sled, and by pulling the first rope length of the third looped end of the stretch-control rope, the user actively controls sliding movement of the foot sled in a first linear direction along the longitudinal rails, and by pulling the second rope length of the third looped end of the stretch-control rope, the user actively controls sliding movement of the foot sled in an opposite second linear direction along the longitudinal rails, thereby urging a knee of the user into flexion and extension at respective points of resistance.

10. A knee range-of-motion exercise device according to claim 9, wherein each of the first and second ends comprises a lateral crossbar interconnecting the longitudinal rails.

11. A knee range-of-motion exercise device according to claim 10, wherein the first crossbar comprises spaced apart guide holes for receiving and guiding the rope through the crossbar.

12. A knee range-of-motion exercise device according to claim 11, further comprising spaced apart rail guides attached to an underside of the foot sled, and adapted for slidably receiving the first and second longitudinal rails.

13. A knee range-of-motion exercise device according to claim 9, wherein the top surface of the mobile foot sled is padded.

14. A knee range-of-motion exercise device according to claim 9, further comprising a pass-through rope guide attached to an underside of the foot sled.

15. A knee range-of-motion exercise device according to claim 9, further comprising an ankle cuff attached to the foot sled adapted for releasably securing the foot of the user to the exercise device.

16. A knee range-of-motion exercise device according to claim 9, further comprising a plurality of surface spacers attached at the ends of the rail assembly for spacing the foot sled from an adjacent supporting surface.

17. A method for exercising a knee of a user to promote an increased range of motion, the method comprising:

providing a knee range-of-motion device comprising:

a rail assembly comprising opposing first and second ends, and first and second laterally spaced, parallel, longitudinal rails;

a mobile foot sled carried on the longitudinal rails, wherein the mobile foot sled is adapted for longitudinal sliding movement between the first and second ends of the rail assembly, wherein the mobile foot sled is adapted for releasably securing a foot of the user to the exercise device, and wherein a top surface of the mobile foot sled spans the first and second longitudinal rails and is configured for resting a user's foot directly thereon; and a single continuous stretch-control rope comprising a first free end directly fixed to the foot sled, a second free end directly fixed to the first end of the rail assembly, a first looped end passed around a first rotatable pulley fixed to the second end of the rail assembly, a second looped end passed around a second rotatable pulley fixed to the foot sled, and a third looped end extending freely outwardly from the first end of the rail assembly for access by a user, the third looped end comprising first and second integrally joined rope lengths;

securing a foot of the user to the mobile foot sled;

grasping the single continuous stretch-control rope;

actively controlling sliding movement of the foot sled between the first and second ends of the rail assembly by pulling the first rope length of the intermediate looped end of the rope, such that the foot sled is moved along the rail assembly in a first linear direction; and pulling the second rope length of the intermediate looped end of the rope, such that the foot sled is moved along the rail assembly in an opposite second linear direction, thereby urging the knee of the user into flexion and extension at respective points of resistance.

* * * * *